US005263269A

United States Patent [19]

Tjärnlund

[11] Patent Number: 5,263,269

[45] Date of Patent: Nov. 23, 1993

[54] HOLDER FOR SHEET OR STRIP SHAPED INFORMATION CARRIERS

[75] Inventor: Royne Tjärnlund, Sörberge, Sweden

[73] Assignee: Svenska Scim AB, Bjartra, Sweden

[21] Appl. No.: 679,025

[22] PCT Filed: Sept. 13, 1989

[86] PCT No: PCT/SE89/00491

§ 371 Date: May 13, 1991

§ 102(e) Date: May 13, 1991

[87] PCT Pub No: W090/03020

PCT Pub Date: Mar. 22, 1990

[30] Foreign Application Priority Data

Sep. 13, 1988 [SE] Sweden ..... 8803223

[51] Int. Cl.[5] ..... G09F 3/20

[52] U.S. Cl. ..... 40/5; 40/649

[58] Field of Search ..... 40/5, 6, 642, 658, 649; 312/234.4; 248/225.1

[56] References Cited

U.S. PATENT DOCUMENTS

| | | | |
|---|---|---|---|
| 3,320,690 | 7/1965 | Forsburg . | |
| 4,334,372 | 6/1982 | Colmar | 40/5 X |
| 4,531,311 | 7/1985 | Howard et al. | 40/649 |
| 4,745,695 | 5/1988 | Hetzer | 40/658 X |
| 4,866,868 | 9/1989 | Kass | 40/651 X |

FOREIGN PATENT DOCUMENTS

| | | |
|---|---|---|
| 0147739 | 7/1985 | European Pat. Off. . |
| 0402662 | 10/1978 | Sweden . |
| 423581 | 5/1982 | Sweden . |
| 2189640 | 10/1987 | United Kingdom . |

*Primary Examiner*—Kenneth J. Dorner
*Assistant Examiner*—Milton Nelson, Jr.
*Attorney, Agent, or Firm*—Bacon & Thomas

[57] ABSTRACT

A holder for sheet or strip shaped information carriers, includes a transparent front plate (1) and a back support plate (2) adapted to be mounted on a support (5, 5*a*–5*c*), especially a shelf edge. A hinge coupling (3) interconnects the front plate (1) with the support plate (2) in such manner that the front plate (1) can be moved between a use-position (FIG. 1) in which the front plate (1) is parallel with the support plate (2) and can retain information carriers between the plates (1,2), and a position for exchange of information carriers (FIG. 2) in which the front plate (1) is pulled down from the use-position and tilted forwardly from the support plate (2). The coupling (3) is preferably adapted to permit forwardly tilting of the front plate (1) only after the same has been moved a certain distance down from the use-position. The information carriers are e.g. labels containing price information and/or other product information.

15 Claims, 3 Drawing Sheets

HOLDER FOR SHEET OR STRIP SHAPED INFORMATION CARRIERS

TECHNICAL FIELD

The present invention relates to holders for sheet or strip shaped information carriers. More particularly the invention relates to holders for information carriers to be mounted on e.g. the edge of a shelf in order to provide information about the products which are displayed or stored in connection with the information carrier. The information carriers are usually labels comprising price information and/or other information about the products. The information can be provided as written matter, as images or otherwise, including machine readable OCR (optical character recognition) writing and bar code.

BACKGROUND OF THE INVENTION

Holders of the above indicated type are extensively used in e.g. supermarkets, department stores, warehouses and similar places where different kinds of goods are displayed or stored. Swedish patents 402,662 (7611481-8) and 423,581 (7711115-1) disclose holders intended for this purpose. The holder consists of an attachment and support part and, connected thereto, a part for receiving information carriers. The last mentioned part is designed as a pocket having its opening pointing upwards. The front wall of the pocket forms the front surface of the holder and the top edge of the front wall closes the pocket either by snapping-in under a projecting portion of the attachment and support part, or by being biasingly pressed against the back of the holder. When inserting/exchanging/removing information carriers the pocket is opened by pressuring on the lower portion of the pocket.

In the above mentioned patents the holders are said to be improvements of the known prior art because they are easy to clean, do not collect dust, make it easy to exchange information carriers and to arrange a plurality of short information carriers side by side with each other, and are simple and inexpensive to make. It is further stated that also the known holders present several of these advantages, but not simultaneously.

Also the holders disclosed in the above mentioned Swedish patents have several drawbacks. It may as an example be mentioned that the slot shaped pocket for the information carriers, which has its opening pointing upwards, remains comparatively narrow even in the open position; this is a drawback when information carriers are to be exchanged. Further, the space within the pocket is substantially independent of the thickness of the information carrier, the result of which is that parts of the information carrier often do not contact the front wall of the holder. Since the pocket is open only as long as pressure is being applied to the lower portion thereof, the user will only have one hand available for the very exchange of information carriers.

Another holder for information carriers, which has been known for a long time, consists of an open pocket of transparent plastics, which has its opening pointing upwards and which can be attached to a shelf edge by means of double-adhesive tape with a lower part of the pocket located below the edge of the shelf. The pocket is opened for exchange of information carriers by pushing on the low portion of the pocket, thereby moving the top edges of the pocket walls apart from each other. When ceasing to push on the lower part of the pocket, the top edges of the pocket will spring back to a position in which they contact each other. This known holder basically has the same drawbacks as the above discussed holders.

SUMMARY OF THE INVENTION

It is an object of the invention to remove or reduce the drawbacks of the prior art holders for sheet or strip shaped information carriers and to provide an improved holder of this kind.

It is a special object of the invention to provide an improved holder for information carriers which in one position has a forward open pocket, the user in said position having both hands available for exchanging the information carriers.

A further object of the invention is to provide an improved holder for information carriers which makes it possible to exchange all of the information carriers carried by the holder at the same time.

A still further object of the invention is to provide an improved holder for information carriers, wherein the information carrier contacts the transparent front wall of the holder substantially independently of the thickness of the information carrier, thereby facilitating the reading of the information on the information carrier through the front wall, visually or by means of an OCR or bar code reader.

A still further object of the invention is to provide a holder for information carriers, the front part of which can be exchanged separately without any need of exchanging the rest of the holder.

These and other objects and advantages of the invention, which also will appear from the following description, are achieved while maintaining the advantages of the prior art holders.

In accordance with the invention, a holder is provided for strip shaped information carriers comprising a back support plate adapted to be mounted on a shelf edge or the like and a transparent front plate coupled to the back support plate in such a manner that, at its normal use position, the front plate extends parallel to and adjacent the back plate for retaining sheet-like information carriers between the plates, but which is movable relative to the back plate by cooperating hinge elements associated with the front and back plates such that, upon downward movement of the front plate relative to the back plate, the front plate may pivot outwardly from the top relative to the back plate to separate the plates from each other to permit movement or replacement of the information carriers. In the lower position, the front plate is secured relative to the back plate by a hinge arrangement that prevents the plates from separating from each other.

The hinge coupling between the front and back plates includes a hinge portion associated with the front plate extending rearwardly of the back plate and resiliently biased against the rearward surface of the back plate so that the front and back plates effectively are clamped together while permitting the front plate to slide vertically upwardly and downwardly relative to the back plate. A detent is provided to prevent inadvertent downward sliding of the front plate relative to the back plate. Other features and details of the invention will be apparent upon a review of the detailed description that follows and the appended drawings.

SHORT DESCRIPTION OF THE DRAWINGS

DESCRIPTION OF PREFERRED EMBODIMENTS

Figure 1B:
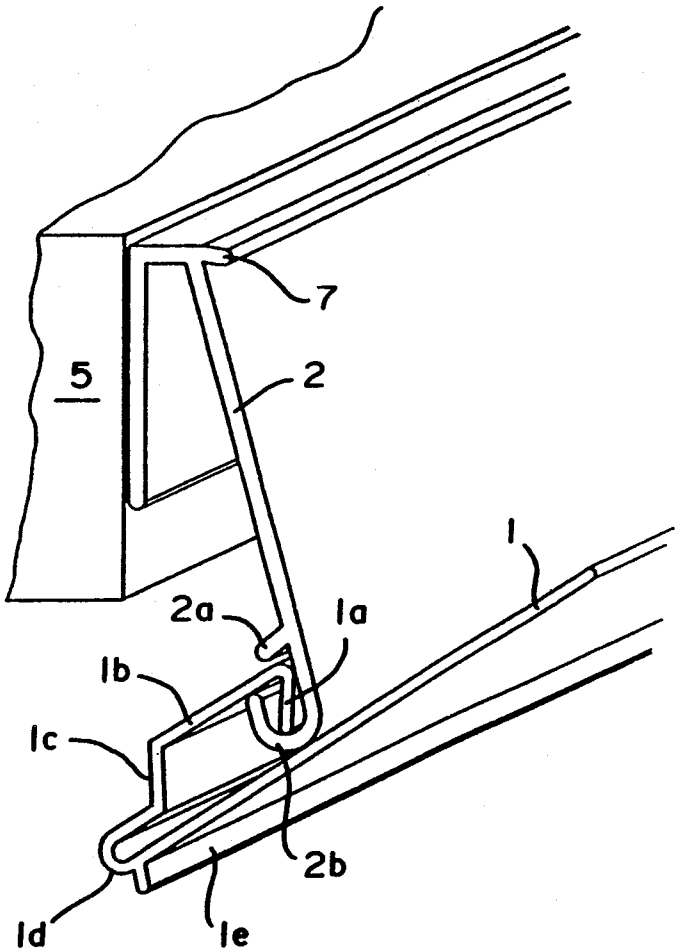
FIGS. 1A and 1B are perspective views showing one end of a presently preferred embodiment of a holder according to the invention in a closed and an open position, respectively.
Figure 1A:
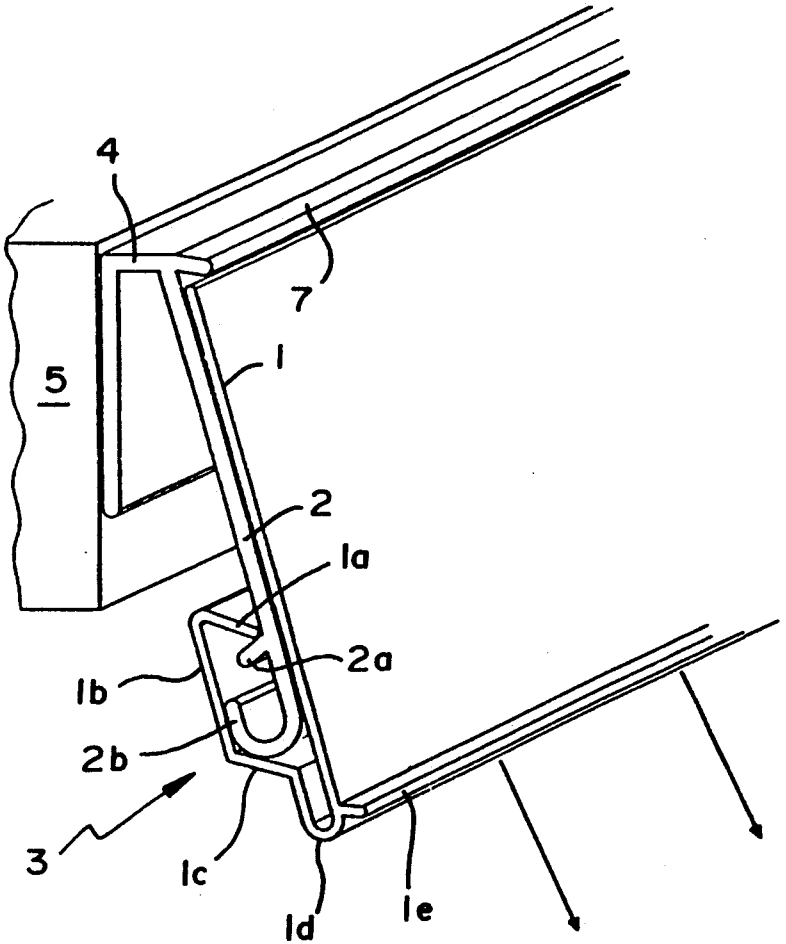

Reference is made to FIG. 1A and 1B which show one embodiment of the holder according to the invention in a closed and an open position respectively. The main parts of the holder are a movable front plate 1, a stationary supporting back plate 2, and coupling means 3 for connecting the front plate 1 with the support plate 2. The support plate 2 is provided with—or attached to—a mounting part 4 for attaching the holder on e.g. a shelf edge 5. The support plate 2 as shown also has a protective rim 7 projecting beyond the top edge of the front plate 1 when the holder is in the closed position.

The main function of the coupling means 3 is to interconnect the movable front plate 1 with the stationary support plate 2 so that the front plate 1 can be moved between the use-position shown in FIG. 1A and the open position shown in FIG. 1B. In the use-position the plates 1 and 2 are parallel to each other and enclose between themselves one or more information carriers (not shown in FIGS. 1A and 1B). In the open position shown in FIG. 1B, the front plate 1 has been pulled down from the support plate 2 and tilted obliquely forwards so as to make it easy to exchange the information carriers.

In the shown embodiment the coupling means comprise a backwardly/upwardly folded extension of the bottom part of the front plate 1 and therewith cooperating means provided on the support plate 2. The extension of the front plate 1 comprises a hinge hook member 1*a*, which preferably extends obliquely downwardly and forms the end of the extension, an intermediate portion 1*b* which is substantially parallel with the front wall 1, and a lower abutment portion 1*c*. The extension 1*b*, which ends with the hook member 1*a*, is resiliently biased against the back of the front wall 1. Such biasing can e.g. be obtained by making the backwardly/upwardly folded extension integral with the front plate 1. At the bottom of the front plate 1 there is preferably a groove 1*d* for receiving the bottom edge of the information carrier. The front plate unit may also preferably be provided with a forwardly extending gripping and support edge or lip 1*e* which may serve both as a gripping part for pulling the front plate down-/pushing it up, and as a support for an OCR and bar code reader upon optical reading of information from the information carrier through the transparent front plate. Because the biasing force keeps the front plate 1 pressed against the information carrier independently of the thickness thereof, the legability of OCR written matter and bar code through the front plate 1 will be improved.

In the shown preferred embodiment the coupling means of the support plate 2 comprise a detent projection 2*a*, which preferably extends obliquely downwardly, on the back of the support plate 2, and a hinge groove member 2*b*. The projection 2*a* cooperates with the hook member 1*a* such that the engagement between said two members keeps the front plate 1 in the top position, said biasing force keeping the front plate 1 pressed against the information carrier. In this position also the intermediate part 1*b* and/or the abutment part 1*c* may, if desired, biasingly contact the groove member 2*b* of the support plate in order to enhance the attachment in the use-position and to make sure that the entire information carrier is kept in contact with the front plate 1. It may be noted that the coupling means do not permit tilting movement of the front plate 1 in the upper use-position.

The holding force is adjusted such that it is great enough to prevent the front plate from unintentionally falling down from the use-position, but not so great that it would not be possible to release the engagement between the elements by pulling the support plate 1 down (as indicated by the arrows in FIG. 1) with reasonable hand power. The magnitude and direction of the holding force primarily depends on the biasing force of the backwardly/upwardly folded portion of the front plate, but may to a certain extent also depend on the angle of the hook member 1*a*, the shape and angle of the projection 2*a* and possibly the design of the cooperating parts 1*b*, 1*c* and 2*a*. It is obvious to a person skilled in the art that the details of the cooperating coupling members can be varied in many ways in order to achieve the functions disclosed according to the invention.

When the front plate 1 is pulled downwards from the position shown in FIG. 1A towards the position shown in FIG. 1B, the front plate is first moved substantially parallel with the support plate 2. When the hook member 1*a* has been pulled beyond the projection 2*a* against the biasing force, the front plate will fall down until the hinge hook member 1*a* (which now has sprung back) engages with the hinge groove element 2*b* at the bottom edge of the support plate 2. By the engagement between the hook member 1*a* and the groove 2*b*, a pivoting or tilting connection will be formed so that the front plate 1 can be pivoted or tilted to the position shown in FIG. 1B. In this position the information carriers are resting freely available on the front plate 1 and can easily be exchanged. It may in this context be noted that all of the information carriers, which are present along the length of the tilted front plate will be available for exchange and/or re-arrangement by means of a single manipulation of the front plate. After having falling down the front plate can very easily be tilted to the position shown in FIG. 2 but its gravity center may, if desired, be so positioned that the plate automatically will tilt to said position after having been pulled down in the direction of the arrows.

After the desired exchange/re-arrangement of the information carriers has been made, the front plate will be tilted back and pushed upwards until the hook member 1*a* springs over the projection 2*a* and fixes the front plate 1 in the starting position according to FIG. 1A.

Figure 3:
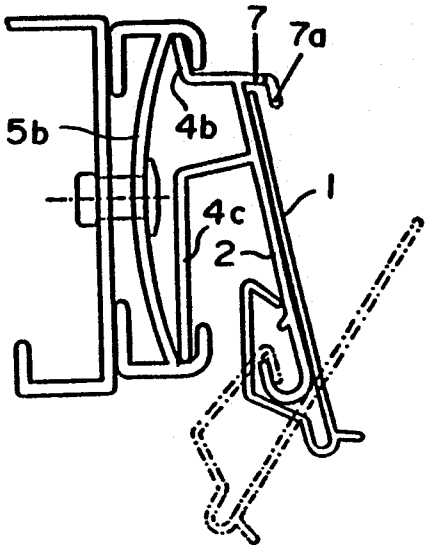
FIGS. 2-4 are cross-sectional views showing the holder according to the invention mounted on three different types of shelves.
Figure 4:
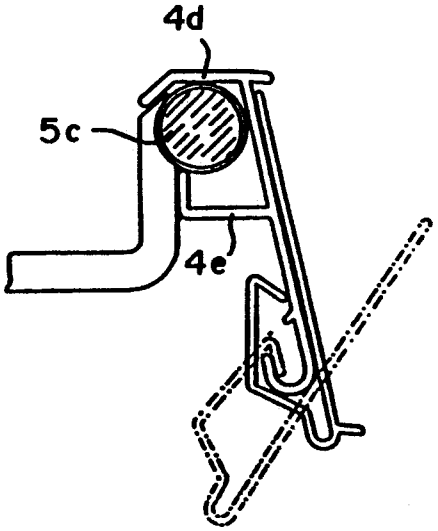
Figure 2:
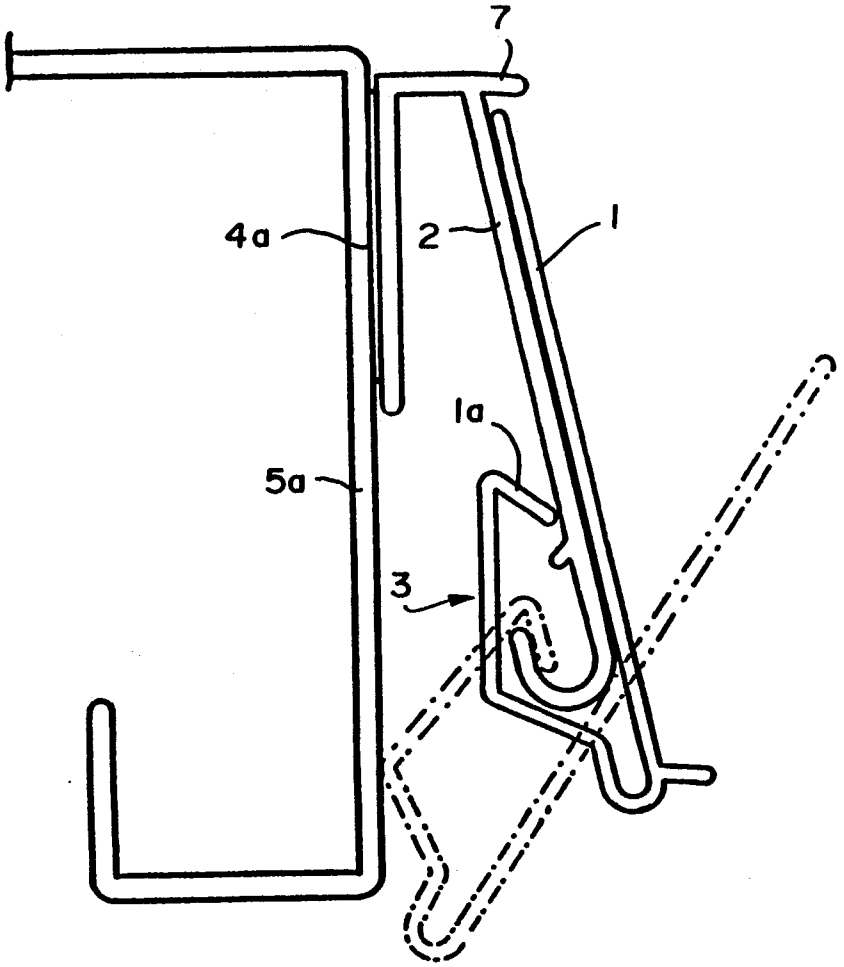

The design of the mounting part 4 of the support plate is only critical for the invention in so far as it should be capable of performing the indicated function, i.e. to attach the holder to a desired support such as a shelf edge. FIGS. 2-4 show some embodiments of the mounting part 4, the open position of the front plate unit being indicated by dashed dotted lines.

FIG. 2 shows mounting on a smooth shelf edge 5*a* by means of a double-adhesive tape 4*a*.

FIG. 3 shows the holder according to the invention adjusted for mounting on a profiled front edge of a shelf. In this case the mounting part comprises a top leg 4*b* and a bottom leg 4*c* in engagement with a C-profile 5*b*. FIG. 3 also shows an alternative embodiment of the protective rim 7, which in this case has a depending end tab 7*a*. In the use-position of the holder the tab 7*a* depends beyond the top edge of the front plate 1, thereby forming a supplemental or alternative means for preventing the front plate 1 from being tilted outwardly in its use-position FIG. 4 shows the holder adapted for mounting on e.g. a wire shelf 5*c*, the mounting part having upper and lower arms 4*d*, 4*e* which engage with the wire shelf.

Figure 5C:
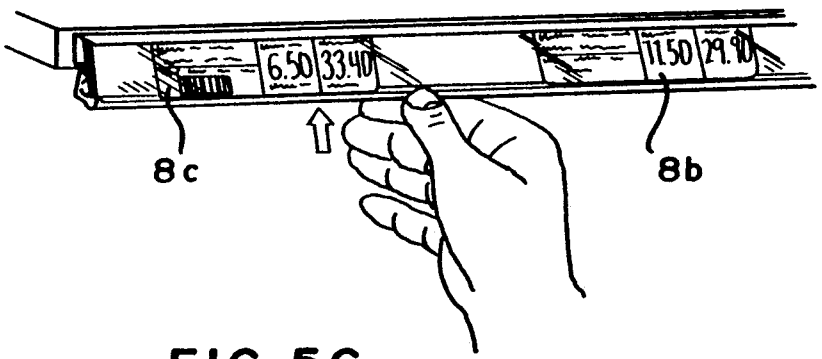
FIGS. 5A-5C are perspective views which illustrate the procedure when changing information carriers in a holder according to the invention.
Figure 5A:
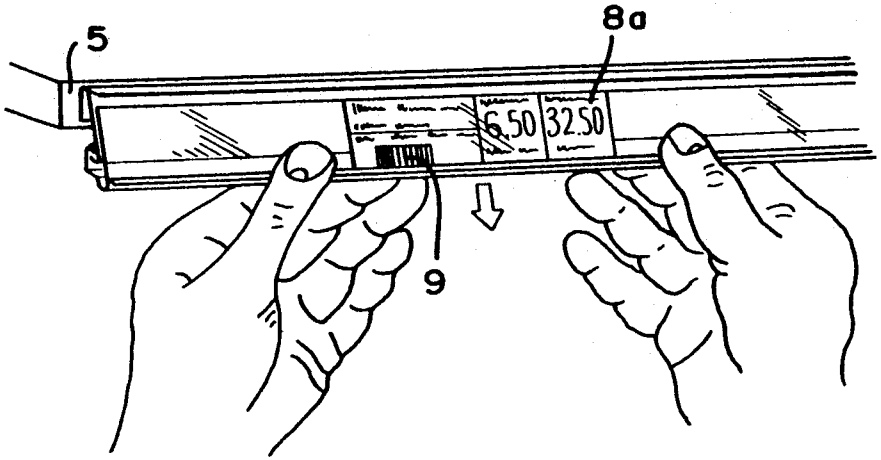
Figure 5B:
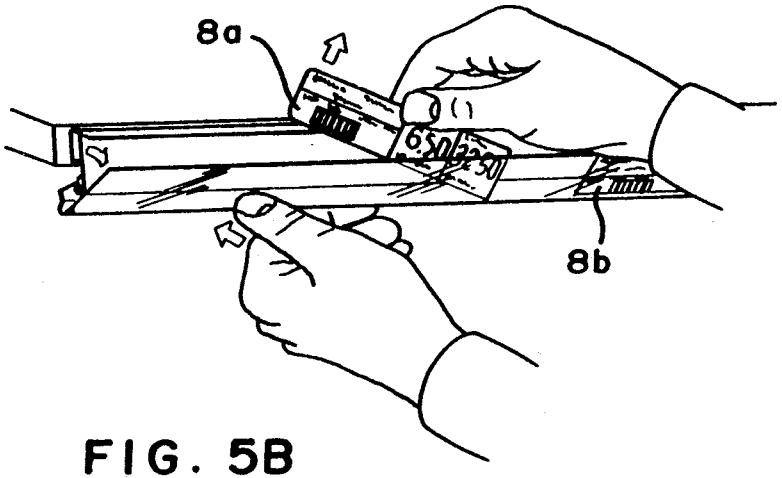

FIGS. 5A–5C illustrate the practical use of the holder according to the invention when exchanging information carriers. In FIG. 5A the holder is shown during the pulling down of the front plate 1 from the closed use-position (compare FIG. 1A) for exchange of an information carrier having the form of a label 8*a* which contains customary written information about the product stored on the shelf, but also information in the form of OCR writing and bar code 9.

In FIG. 5B the front plate 1 has been tilted to its open position (compare FIG. 1B) and the label 8*a* is being removed from the holder. Other labels, which are carried by the same holder, rest on the inside of the front plate, comfortably available if also they are to be exchanged but still remaining in an unchanged position if they are to remain. See the second shown label 8*b* in FIG. 5B. It is to be noted that the front plate 1 remains in the open position once it has been tilted to said position. Therefore, the user can unobstructedly use both hands for exchanging/adding/rearranging labels along the entire front plate 1 (which may have a length of about one meter). FIG. 5*b* illustrates depression of the bottom edge of the front plate for tilting the front plate to the open position but, as mentioned above, the front plate may be so designed that such tilting takes place automatically after the front plate has been pulled down.

FIG. 5C illustrates how the front plate 1 is returned to the closed position by pushing the same upwards when the label 8*a* has been replaced by a new label 8*c*.

Figure 6:
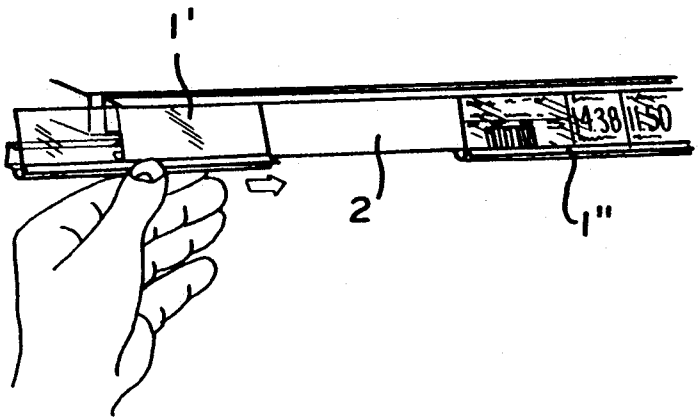
FIG. 6 is a perspective view which illustrates a variant of the holder according to the invention.

FIG. 6 shows a modified embodiment in which a common support plate 2 carries two or more short front plate parts 1', 1'', each of which may carry one or more labels. FIG. 6 also illustrates that front plate parts can be connected to the support plate part 2 by being slid onto the same side-wise, but they can also easily be connected to the support plate by being pushed from below so that the hook member 1*a* will snap over the groove member 2*b* of the support part.

The invention is, of course, not intended to be restricted to the special embodiments which have been described above and shown in the drawings, but many variations and modifications are possible within the scope of the appended claims.

I claim:

1. A holder for sheet or strip information carriers comprising a transparent front plate; a back plate having means for securing the back plate to a support; and coupling means for interconnecting the front plate with the back plate in a closed, normal use position wherein the front plate extends substantially parallel to and adjacent the back plate for retaining information carriers between the plates, said coupling means comprising cooperating hinge means for releasably securing the front plate, in the closed, normal use position, against downward movement relative and substantially parallel to the back plate and for permitting downward movement and outward pivotal movement of the front plate relative to the back plate to separate the front plate from the back plate such that the front plate assumes an open position; said coupling means including means for retaining the front and back plates coupled to each other in both the closed, normal use position and said open position, said coupling means further including means for resiliently biasing one portion of the hinge means on the front plate forwardly against a rearwardly facing portion of the back plate.

2. A holder as claimed in claim 1, wherein said coupling means includes a detent means cooperating with the biasing means for normally resisting downward movement of the front plate relative to the back plate until the biasing force of the biasing means against the detent is overcome.

3. A holder as claimed in claim 1, said front plate including means for receiving and retaining information carriers.

4. A holder as claimed in claim 1, said front plate including a lower edge portion and a forwardly projecting lip adjacent said lower portion.

5. A holder as claimed in claim 1, wherein said means for retaining the front and back plates together comprises a hinge hook portion carried by one of the front and back plates, and a hinge groove portion carried by the other of the front and back plates for receiving said hook portion.

6. A holder as claimed in claim 5, wherein said hinge hook and hinge groove portions are each integrally formed with a respective one of said front and back plates.

7. A holder as claimed in claim 1, wherein said back plate includes an upper edge area and a forwardly projecting protective rim at said upper edge area.

8. A holder as claimed in claim 7, said rim including a downwardly projecting lip means at its forward edge for retaining the front plate at its non-pivoted normal use position, while permitting downward movement of the front plate relative to the back plate.

9. A holder for sheet or strip information carriers comprising a transparent front plate; a back plate having means for securing the back plate to a support; and coupling means for interconnecting the front plate with the back plate in a closed, normal use position wherein the front plate extends substantially parallel to and adjacent the back plate for retaining information carriers between the plates, said coupling means comprising cooperating hinge means for releasably securing the front plate, in the closed, normal use position, against downward movement relative and substantially parallel to the back plate and for permitting downward movement and outward pivotal movement of the front plate relative to the back plate to separate the front plate from the back plate such that the front plate assumes an open position; said coupling means including means for retaining the front and back plates coupled to each other in both the closed, normal use position and said open position; said hinge means comprising a continuous rearwardly, upwardly and forwardly extending hinge hook portion at the lower edge area of said front plate, and a rearwardly and upwardly extending hinge groove portion at the lower part of the back plate, said hook and groove hinge portions being disengaged when the front and back plates are in their normal use position, but pivotally coupled together upon downward and forward pivotal movement of the front plate relative to the back plate.

10. A holder as claimed in claim 9, wherein downward movement of the front plate relative to the back plate causes engagement of said hook and groove hinge portions and automatically causes said front plate to pivot to said open position.

11. A holder as claimed in claim 9, wherein said front plate includes groove means along its inside lower front edge area for retaining and carrying a sheet like information carrier.

12. A holder as claimed in claim 11, wherein said front plate includes a forwardly protecting lip along its lower front outer edge for providing a grasping area for moving the front plate downwardly relative to the back plate to cause engagement of the hinge hook and groove portions.

13. A holder as claimed in claim 9, wherein said upwardly and forwardly extending hinge hook portions of said front plate are resiliently biased against the back side of the back plate opposite the side of the back plate facing the front plate.

14. A holder as claimed in claim 13, including a rearwardly extending detent lip on the back side of the back plate between the position of the forwardly extending portion of the hinge hook portion when the front plate is in its normal use position and the position of the forwardly extending portion of the hinge hook portion when the hook and groove hinge portions are coupled together, wherein said detent lip normally prevents inadvertent downward movement of the front plate relative to the back plate until the forward extending hinge hook portion traverses the detent lip against the resilient biasing force.

15. A holder as claimed in claim 13, wherein said forwardly extending hinge hook portion is also downwardly inclined.

* * * * *